United States Patent [19]

Temple et al.

[11] 4,120,124

[45] Oct. 17, 1978

[54] MOVABLE WALL ASSEMBLY

[75] Inventors: Philip A. Temple; Gene B. Hasbrouck, both of Corry, Pa.; Stanley M. Howe, Muscatine, Iowa

[73] Assignee: Hon Industries Inc., Muscatine, Iowa

[21] Appl. No.: 808,640

[22] Filed: Jun. 21, 1977

[51] Int. Cl.[2] ..... E04B 2/56

[52] U.S. Cl. ..... 52/122; 52/36; 52/238

[58] Field of Search ..... 52/122, 36, 238, 239, 52/220, 221

[56] References Cited

U.S. PATENT DOCUMENTS

| | | | |
|---|---|---|---|
| 2,881,876 | 4/1959 | Williams | 52/238 X |
| 3,411,252 | 11/1968 | Boyle | 52/122 |
| 3,844,079 | 10/1974 | Karrip | 52/122 |
| 3,862,524 | 1/1975 | McCrackin | 52/36 |
| 3,885,361 | 5/1975 | De Schutter | 52/122 |
| 3,999,353 | 12/1976 | Dielman | 52/122 |
| 4,031,675 | 6/1977 | Roberts et al. | 52/122 X |
| 4,043,086 | 8/1977 | Kaulfuss et al. | 52/36 |

FOREIGN PATENT DOCUMENTS

| | | | |
|---|---|---|---|
| 2,344,373 | 3/1975 | Fed. Rep. of Germany | 52/122 |
| 2,510,949 | 9/1976 | Fed. Rep. of Germany | 52/122 |

*Primary Examiner*—J. Karl Bell

*Attorney, Agent, or Firm*—Neuman, Williams, Anderson & Olson

[57] ABSTRACT

A movable wall assembly is provided to selectively partition an interior space. The assembly includes a base member having support elements therealong, and a leveling support bar on which the partition is assembled overlying the support elements and adjustable with the support elements to effect leveling thereof. Wall panels are supportably mounted on the support bar, being maintained in place by slotted support post members between the wall panels which engage the panels. The post members are secured to the support elements on the support bar, and to tie pieces extending between adjacent panels along upper edges of the panels. A method of leveling the movable wall assembly is also provided whereby the assembly can be leveled prior to mounting and securing the wall panels on the leveling support bar.

29 Claims, 25 Drawing Figures

FIG. 1
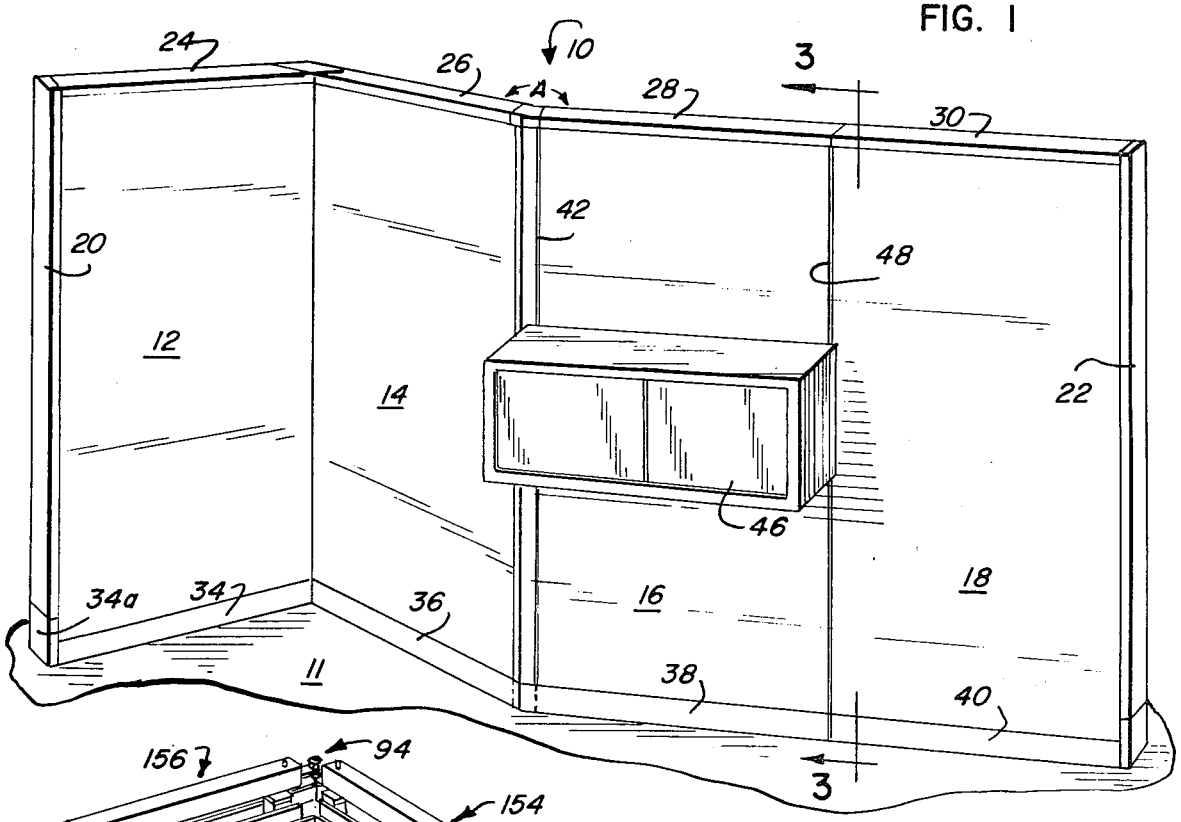
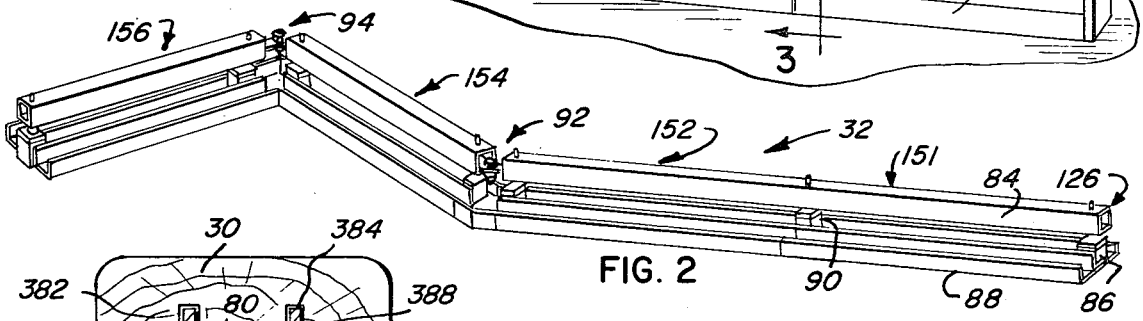
FIG. 2
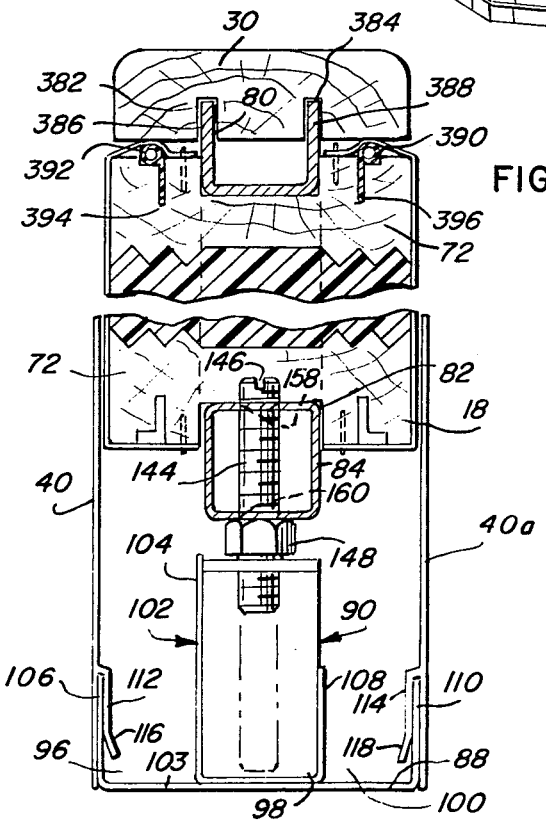
FIG. 3
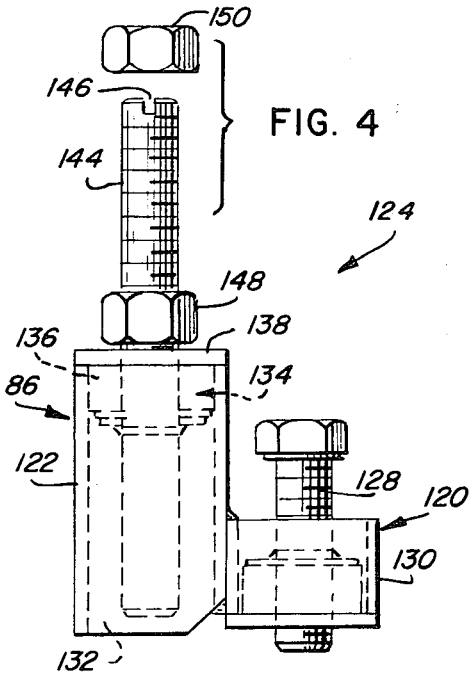
FIG. 4

FIG. 11
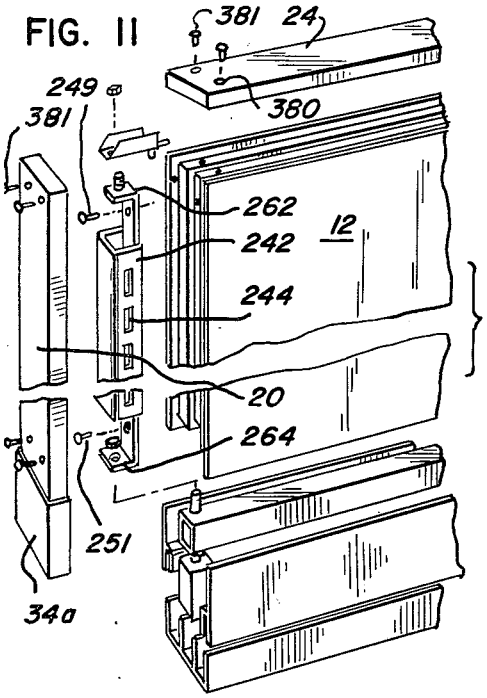
FIG. 13
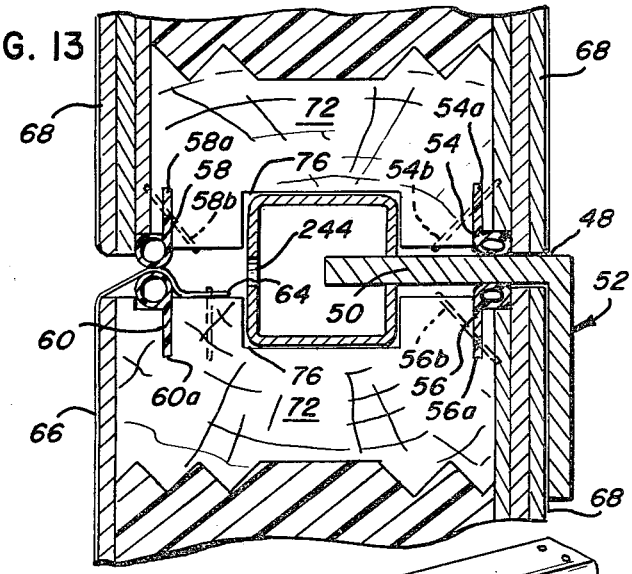
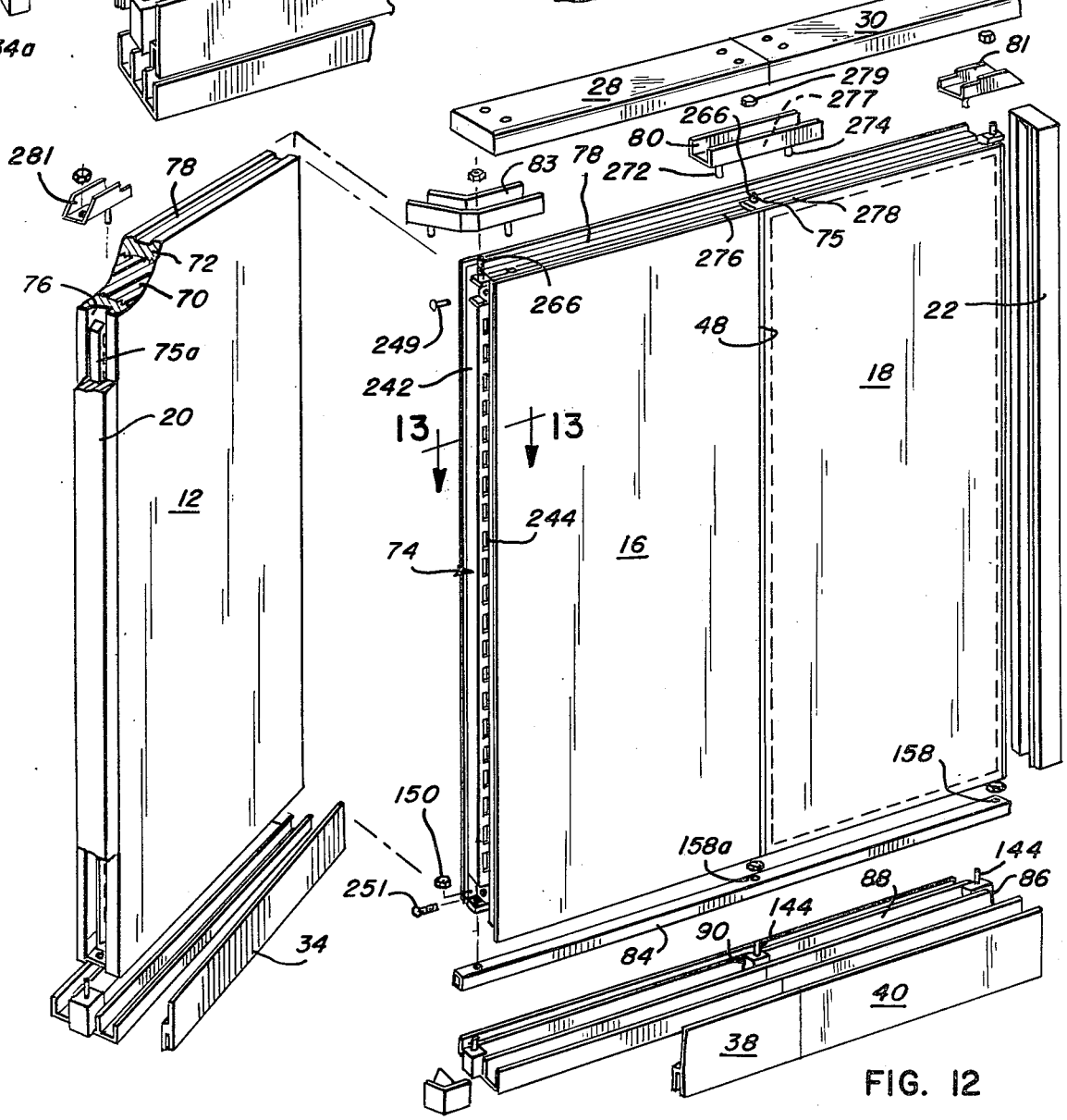
FIG. 12

MOVABLE WALL ASSEMBLY

BACKGROUND OF THE INVENTION

This invention relates to movable partition or wall assemblies and associated methods of installing such assemblies, and more particularly assemblies and methods relating to free-standing partition systems capable of supporting shelving or other units attachable thereon.

In modern open-space office buildings it is frequently desirable to partition large spaces into comfortable, aesthetically pleasing, yet functional areas serving as individual and/or conference rooms, project areas and the like. The floor of such spaces often is uneven and not level. Yet to provide a uniform partition of prefabricated units requires a uniform, preferably level, reference on which to build. It is equally important that a wall assembly employed to partition such space be easily and simply installed, moved, and reassembled to facilitate changing space allocation requirements. Such a free-standing wall assembly preferably is adapted to accommodate shelving or other wall-mounted units. The assembly also should be capable of providing telephone and/or electrical service to each partitioned area, and be able to accommodate a variety of panel surfaces or configurations while providing a simple and pleasing assembly design appearance.

As an aid to an office space planner in designing for, and utilizing the space in a most efficient manner, the wall panel segments must be positionable, relative to adjacent panel segments, at a variety of angles. Similarly, deficiencies in space allocation or mistakes in a layout may be quickly identified and easily corrected, if the assembly layout can be viewed in position prior to mounting the upstanding wall panels on the underlying support structures. The latter function should be provided without hindering or adding to the normal assembly of the entire wall assembly.

To obtain the full utility of a movable wall assembly, however, installation, movement and reassembly of the assembly must be uncomplicated and efficient. A multiplicity of parts, difficult and intricate leveling procedures, frequently with wall panels in place, and reassembly securing techniques have contributed to problems encountered with past configurations.

OBJECTS OF THE INVENTION

Accordingly, it is an object of this invention to provide an improved movable wall assembly meeting the aforestated requirements.

It is a further object of this invention to provide an improved movable free-standing wall assembly which will conform to a floor support surface and yet provide a predetermined level support for the wall panels regardless of irregularities of the basic floor surface on which the assembly is located.

It is another object of the present invention to provide an improved and simplified movable wall assembly and method for selectively partitioning an interior space into predetermined areas.

It is another object of the present invention to provide an assembly and associated method whereby the assembly is modular and is easily installed, moved and reassembled in an uncomplicated and efficient manner.

It is still another object of this invention to provide a wall assembly which is free-standing, is able to accommodate a variety of wall panel configurations and securely support a variety of wall-mounted units without detracting from the outward appearance of the wall assembly.

SUMMARY OF THE INVENTION

The foregoing objects are achieved by a free-standing movable wall assembly according to the invention which includes an elongated base, accommodating therein adjustable supports spaced from one another, and an elongated leveling support bar overlying the supports. The bar is spaced from and extends longitudinally of the elongated base, and may be a single bar element or a plurality of bar segments appropriately joined to one another to extend the length of the wall assembly. Edge-grooved wall panels are supportably mounted on the support bar, and are secured in place by slotted vertical posts which engage in the wall panel side grooves for mutual support. The posts are supported on the bar and attached to the adjustable supports. Tie pieces extend between and are joined to the upper portions of adjacent wall panels and to the upper ends of the vertical posts.

The assembly as above-summarized is adapted for establishing a level support reference prior to mounting the wall panels and posts on the support bar. After the bar is in place, the adjustable supports on which the bar is mounted are independently adjusted to level the bar. Because the wall panels and posts are mounted directly on the bar, the panels assembled thereon will be uniformly leveled and assure ease and uniformity of assembly and uniform spacing and vertical alignment therebetween. Accordingly, adjustment of the assembly to achieve a leveled condition thereafter will be unnecessary, and proper leveling and integration of the entire assembly will be assured.

Other objects, advantages and features of the invention will become apparent upon considering the following detailed description and appended claims, and upon reference to the accompanying drawings.

BRIEF DESCRIPTION OF THE DRAWINGS

For a more complete understanding of this invention, reference should now be had to the embodiment illustrated in greater detail in the accompanying drawings and described below by way of an example of the invention.

In the Drawings

FIG. 1 is a perspective view of the preferred embodiment of a wall assembly embodying principles of this invention shown in place over a floor surface and illustrating a wall-mounted unit in position thereon.

FIG. 2 is a perspective view of a base sub-assembly of FIG. 1, shown in a corresponding positional relation to the wall assembly of FIG. 1.

FIG. 3 is an enlarged fragmentary cross-sectional view of the wall assembly of FIG. 1, taken along line 3—3 thereof.

FIG. 4 is an enlarged side view of an adjustable support unit with an anchoring post attached thereto, and an associated nut shown in exploded relation.

FIG. 11 and 12 are partial perspective views of an wall assembly of FIG. 1, with various components in exploded relation.

FIG. 13 is an enlarged horizontal section view of the wall assembly of FIG. 12, taken along line 13—13 thereof, and showing a hanging unit support bracket secured to a slotted post of the wall assembly.

Figure 5:
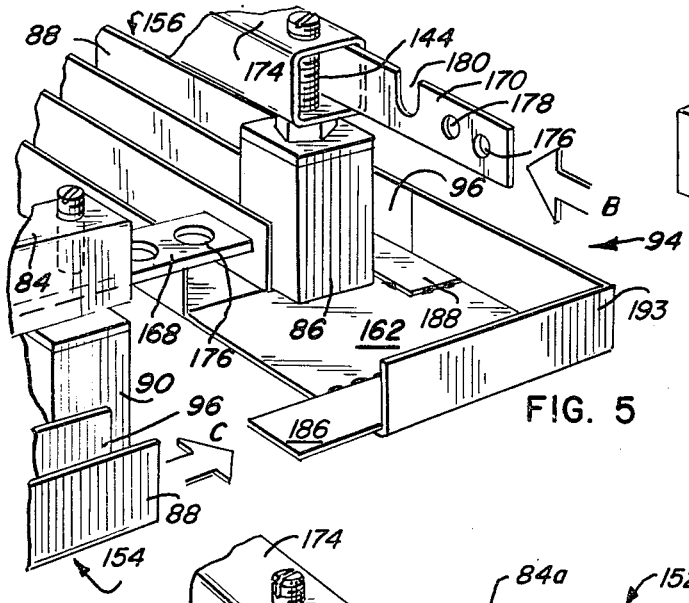
FIG. 5 is an enlarged partial perspective view of the sub-assembly of FIG. 2, where two assembly segments form a substantially right angle corner, illustrating the initial assembly step between assembly segments.

While the invention will be described in connection with a preferred embodiment, it will be understood that it is not intended to limit the invention to that particular embodiment. On the contrary, it is intended to cover all alternatives, modifications and equivalents as may be included within the spirit and scope of the invention as described by the appended claims.

Turning now to the drawings, and principally FIG. 1, the preferred embodiment of a movable wall assembly 10 is shown in position over a floor surface 11, according to a predetermined space allocation plan. The assembly includes individual wall panels 12, 14, 16, 18 which are finished along their exposed peripheral edges by end caps 20, 22 and top caps 24, 26, 28, 30, with the caps being detachable from the corresponding wall panels. A support sub-assembly 32 (FIG. 2) is finished with cover plates 34, 36, 38, 40 inserted thereover at the lower edges of the wall panels. A filler piece 42 is shown between wall panels 14, 16, which extend angularly from one another at approximately 135°, as indicated by arrow A in FIG. 1. One of a variety of possible wall mounted hanging units 46 is shown in position on the wall assembly 10.

The support sub-assembly 32 includes, for example, a base channel element 88 which rests on and conforms to the floor 11 and receives a plurality of spaced adjustable support units 86, 90, and a support bar 84 adjustably mounted on the support units. In the preferred embodiment the components of base 88 are of modular lengths, corresponding to the lengths of the individual panels to be assembled thereon while the bar 84 is of appropriate greater unit lengths e.g., up to 8' in length, to facilitate installation and leveling of extended linear runs. The wall panel structure, which is erected on the sub-assembly 32, includes the panels 12, 14, 16 and 18, with identical slotted support posts 74, 75 (FIG. 12) extending vertically along the vertical edges of each panel. Each post serves to support the contiguous panel(s) along its (their) vertical edge(s) with engaging panels providing rigidity for the posts in supporting units hung on the posts. The upper edges of the panels and posts are tied together by tie pieces 80, 83. Top caps and the end caps 24, 26, 28, 30, and 20, 22 along with the cover plates 34, 36, 38 and 40 complete the assembly. The top caps and cover plates also preferably are of lengths corresponding to the widths of the selected panels. While the described modularity of components is preferred, wherein the several components correspond in length to the selected widths of the panels (which may be of various widths), it will be appreciated that the components may be made of continuous lengths in accordance with a predetermined design, and/or the bar 84 may be of modular lengths by utilizing extender splices as described below.

The sub-assembly 32 may be layed out in conformity with a desired wall arrangement, e.g., as illustrated in FIG. 2, prior to the mounting of the wall panels thereon. Moreover, through the unique structure of this invention the support bar may be leveled, despite irregularities of the support surface 11, prior to assembly of the wall panel structure thereon. Thus a uniform predetermined level support bar of sub-assembly 32 accommodates the wall panels and related components, and thereby facilitates mounting and interrelation of the components, with a resultant ease of assembly and uniform aesthetic appearance of the finished assembly.

Figure 24:
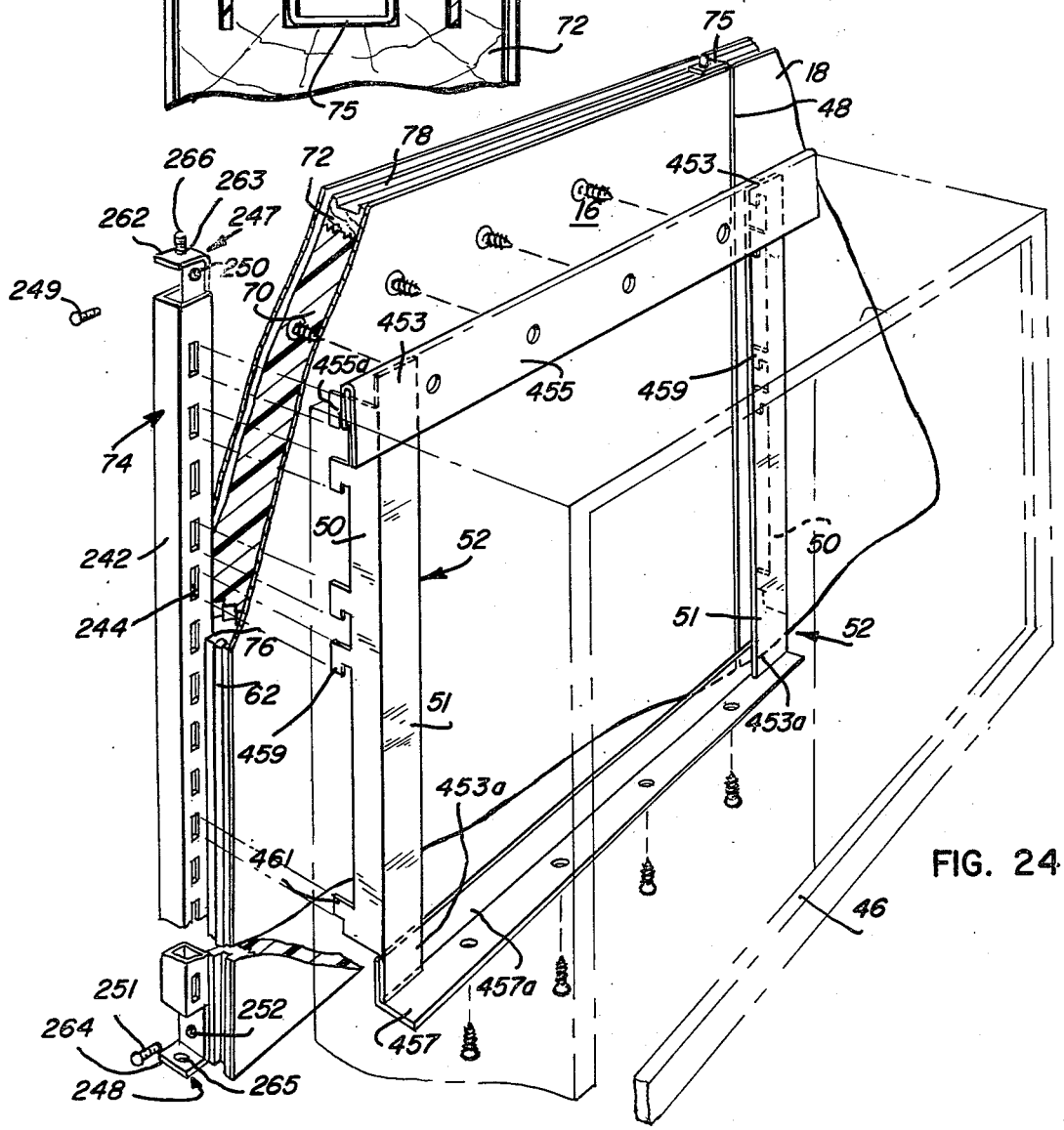
FIG. 24 is an enlarged fragmentary perspective view of a wall panel member, partially cut-away, with wall hanging brackets shown exploded therefrom.

Referring now to particular components, each wall panel is an integral structural unit that is prefabricated, preferably with prefinished surfaces whereby the complete assembly yields a finished appearance when the various components are properly assembled. Referring for example to FIGS. 12 and 24, each of these panels includes a peripheral frame 72 formed with external grooves 76, 78 along all outer edges. The illustrated panels 16 and 18, for example, may include a lightweight sound-absorbing core material 70. A variety of covering materials may be selected to finish the outer wall panel surfaces as desired, including colored fabrics 66 and/or a wood veneer 68 (FIG. 13). In addition, a window or opening (not shown) may be provided in selected wall panels.

When assembled, the wall panels 12, 14, 16, 18 are spaced from each other such that an opening or slot 48 between adjacent wall panels will receive the inwardly extending hooked flange 50 of a hanging unit mounting bracket 52 therein, see e.g., FIGS. 1, 13, and 24. As further illustrated in FIG. 13, the space 48 between adjacent wall panels 16, 18 is visually closed or blocked by compressible vinyl edging strips 54, 56 on one side of wall panels 16, 18, and corresponding edging strips 58, 60 on the opposite side of the wall panels. The edging strips are accommodated in strip recesses 54*a*, 56*a*, 58*a*, 60*a* along the vertical edges of the frames 72, for example, being secured therein by staples 54*b*, 56*b*, 58*b*. These strips extend along the entire height of each panel to close the openings 48 between adjacent panels 16, 18 and to provide a consistent closure and design appearance at all vertical joints (see edging strip 62 shown in panel 16 of FIG. 24). Corresponding strips 390 and 392 also extend along the tops of the panels (FIG. 3) to cooperate with the top caps, as will be referred to further below.

The edging strips may also be retained in place by securing the end 64 of a panel covering fabric 66 over an edging strip 60, for example, if a fabric covering has been selected for a particular wall panel surface. Placing the compressible strips behind the plane of the panel surface will result in the fabric forming a clean consistent appearing edge at the corner or bend at the edge of frame 72, whereby uniform straight-edged reveal lines are assured. The vinyl edging strips 54, 56, 58, 60 and 62, are resilient and readily compressible to allow the edging strips to be pushed aside and compressed when a mounting bracket 52 is inserted into opening 48, as shown in FIG. 13. When bracket 52 is removed from opening 48, the edge strips will expand to their original abutting position, visually closing off the opening or gap 48 between panels in an aesthetically pleasing and consistent reveal line.

The grooved wooden frame 72 (FIG. 24) adds structural strength to each wall panel while also coacting with other assembly components along each edge, as further described hereinafter. As shown in FIGS. 12, 13, 24, slotted support posts 74, 75, for example, are accommodated in the frame side grooves 76. When the support posts 74, 75 are secured to the underlying sub-assembly 32, they cooperate with the frame 72 to maintain the wall panels in place and to support wall hung units 46. Referring to FIGS. 3 and 12, top groove 78 accommodates therein closely interfitting top panel tie pieces 80, 81, 83 which extend between, and are secured to, adjacent wall panels. Because the tie pieces 80, 81, 83 are maintained in lateral position by the groove 78 of each frame 72 adjacent to each joint or junction, a secure junction between adjacent wall panels is established.

The groove 82 along the base of each wall panel is adapted to partially accommodate the longitudinally extending support bar 84 in a tonque and groove fashion. As such, each wall panel will be automatically aligned over the subassembly 32 when it is mounted on the leveling bar 84.

Each segment of the base sub-assembly 32 includes adjustable support units 86, 90, on which the bar 84 is supported and positioned, and a base 88 which accommodates the support units 86, 90 and provides a service raceway, e.g., for electrical and telephone services. To assemble a complete sub-assembly in accordance with a desired space plan, other base sub-assembly segments similar to that defined above are connected together directly or through angular connecting components 92, 94 (FIG. 2), depending on the planned angular disposition of the wall panels relative to each other. It should be appreciated that once a complete base sub-assembly has been installed on a floor surface, an entire overview of the planned space can be had whereby any further changes in partitioning of the space can be made before mounting wall panels thereover.

The base 88, shown in FIGS. 2, 3 and 12, is adapted to rest on a floor surface and conform substantially to the contour thereof. The base 88 is divided into three separated troughs 96, 98, 100, the outer two 96, 100 being adapted to carry electrical and/or telephone service cables, while the support units 86, 90 are accommodated in the central trough 98. These troughs are defined by a substantially U-shaped elongated inner channel piece 102 which is welded in place within the U-shaped outer base channel 103. One sidewall 104 of piece 102 extends substantially above the other base and trough-defining flanges 106, 108, 110 so as to provide adequate separation between electrical and telephone service cables carried in side troughs 96, 100 while adding structural support to the support units 86, 90 accommodated in the central trough 98. After the service cables have been placed in the base 88 and a wall panel 18 is mounted over the sub-assembly 32, cover plates 40, 40*a*, for example (FIG. 3), may be positioned over upstanding flanges 106, 110 of base 88, to present a clean outward appearance between the floor surface 11 (FIG. 1) and the wall panels 12, 14, 16, 18. Inwardly and downwardly extending cover plate flanges 112, 114 define pockets in which base flanges 106, 110 are accommodated when the cover plates are mounted. These pockets provide vertical adjustability so that the cover plates can conform to the floor surface 11. The inwardly curved end portions 116, 118 of respective flanges 112, 114 facilitate proper placement of the cover plates over the base flanges. It will be appreciated that the cover plates are not structural components and may be removed and replaced at any time for access to the housed wiring and to the support units 86, 90 after a complete partition 10 is in place.

Each support unit 86, 90, shown as examples in FIG. 3 and the left portion of FIG. 4, includes a housing 122 defining an interior space 132 into which a leveling structure 134 extends. The leveling structure 134 includes a screw cap 136, having a top 138 that extends over housing 122 and abuts therewith when in position. A threaded bolt shank 144 is screwed into the screw cap 136, and extends upwardly from top 138 and housing 122. A screwdriver-accommodating slot 146 is provided at one end of shank 144 to facilitate adjustment thereof relative to housing 122, as further explained below. An adjusting nut 148 is spot-welded to shank 144 at a predetermined spacing from the upper slotted end which exceeds the vertical dimension of the support tube 84, as shown in FIG. 3. Thus, as shank 144 is adjusted relative to cap 136, nut 148 will move with the shank. The shank and attached nut also may be adjusted by turning the nut 148. Since access may be had to the nuts 148 simply by removing the cover plate 40 or 40*a*, leveling readjustment also is available after the assembly 10 is complete. A securing nut 150 may be threaded over shank 144 to secure components of the wall assembly in place when the wall panels are mounted over the sub-assembly 32.

The support units 86, 90 normally are identical, and each rests in the inner trough 98. However, a support unit, such as shown in FIG. 4, may include an anchoring post 120 welded to a side of housing 122. The combined support-anchoring unit 124 may be employed at the end or ends of a sub-assembly system 32, such as in FIG. 2 where, because of the contour of the underlying floor surface, an end 126 (for example) of the sub-assembly would either not abut with the floor surface or could be easily moved over a carpeted floor surface. In either event, anchoring screw 128 could be turned in anchor housing 130, so as to extend through an opening provided in base 88 (not shown) and anchor against the floor surface. More commonly, however, the support unit 86 alone will be utilized along the base 88.

Each elongated support bar 84 extends over adjacent support units 86, 90. The illustrated bar is a hollow, closed square tube (FIG. 3) which is provided with a set of aligned top and bottom guide openings 158, 160, 158*a*, 160*a* (FIG. 12) at spacings corresponding to the nominal widths of the selected panels. These openings are adapted to accommodate shank portions 144 of respective support units 86, 90 which are located at each panel joint and edge. When support bar 84 has been positioned over shanks 144, it will rest against the respective adjusting nuts 148 welded to shanks 144. The extension of respective shanks 144 through bar 84 will maintain the bar in a proper lateral position.

Thus, a sub-assembly segment 151 including a base 88, two support units 86, 90 and a support bar 84 has been described. A plurality of such segments 152, 154, 156 (FIG. 2) are joined together in a desired relative relation to establish a complete sub-assembly 32.

A slotted support post 74, 75 is provided at each panel joint and each free panel edge in assembly 10. As previously noted, a support unit 86, 90 is provided beneath the location of each such post, for attachment and support of the post. Thus the support units overlap the end edges or abutment joints between the segments of base channels 88.

It will be appreciated that a bar 84 must extend beyond the underlying base 88 if it is to be accommodate over shank 144 of a unit 86, 90 at each panel edge and afford securement for the L-shaped end flange 233 (FIG. 9) of the slotted post at the respective overlying panel joint. Thus, under normal circumstances the ends of each support bar will extend beyond the corresponding base components (see FIGS. 5, 7, 9, 12, 16, 18, 20, 21). This is of no consequence when a change of direction or corner is contemplated at the end of the leveling bar. However, if two bars are to be joined without a direction change, the extender bar must be of a slightly shorter longitudinal dimension, as will be pointed out further below in describing a coplanar joint as in FIG. 9.

Depending on the planned relative angular disposition of the wall panels, various connecting arrangements may be required between adjacent sub-assembly segments. The wall assembly of this invention is adapted for ease of assembly into any of a variety of angular relationships between adjacent panels, as well as in coplanar series. A right angle connecting unit 94 and a 120° unit 92 are both shown in FIG. 2. A variety of other interconnection units may be employed, as discussed hereinafter. As a representative example of how adjacent sub-assembly segments are interconnected at an angle, the steps of interconnection between segments 154, 156 via right angle unit 94 will be described in detail.

Figure 6:
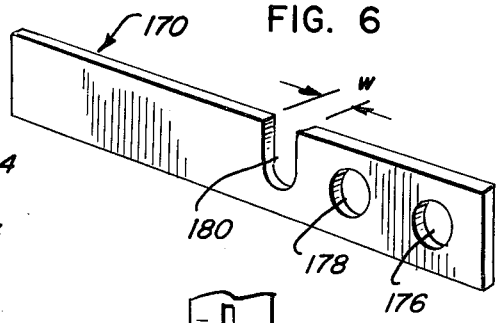
FIG. 6 is an enlarged perspective view of a connector tie strap, as shown in FIG. 5.
Figure 7:
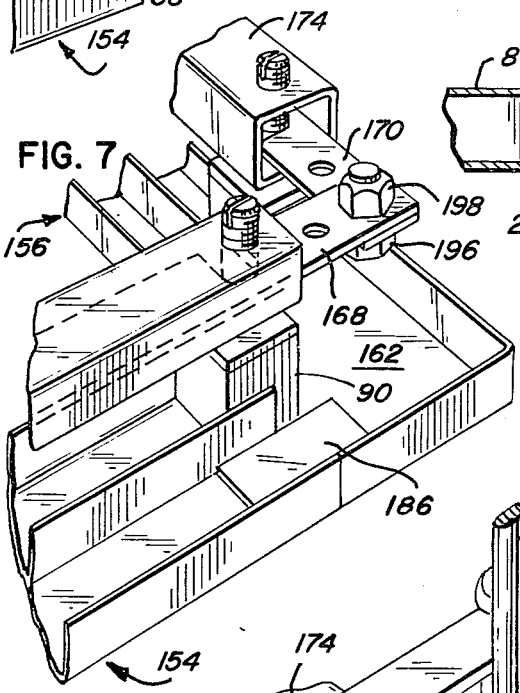
FIG. 7 is a perspective view similar to FIG. 5, but with the assembly segments shown in assembled relation.

Referring to FIGS. 5 and 7, the connecting unit 94 includes a right angle base plate 162 joining bases 88 of two respective sub-assembly segments 154, 156, and two connector tie straps 168, 170 adapted for insertion into the open end of respective bars 84, as indicated by arrow B. Each tie strap, for example strap 170 (FIG. 6), is an elongated flat metal piece having two bolt-accommodating openings 176, 178 toward one end thereof, and a U-shaped cut-out 180 adjacent to the openings. The width-wise dimension W of the cut-out is of approximately the same dimension as shank 144 (FIG. 5) on each support unit 86, 90.

To facilitate proper registration between the two bases 88 and base plate 162, tongue portions 186, 188 extend from base plate 162 and are adapted for insertion into the respective outermost troughs 96 of each base 88. The base plate is also provided with an upstanding flange 193 which joins with flanges 106 on respective bases 88.

As shown by arrow C in FIG. 5, sub-assembly segments 154, 156 are moved into abutting registration with base plate 162. Tie straps 168, 170 may be inserted into respective support bars 84 before or after moving segments 154, 156 into registration with base plate 162. Each strap is of a width substantially equal to the width of the openings in the bars 84. The straps are secured to respective shanks 144 by inserting each strap 168, 170 into the open end of each support bar 84 in a vertical position as at arrow B in FIG. 5 until cut-out 180 and shank 144 are substantially aligned. Thereafter, strap 170 is turned inwardly to a substantially horizontal position, with cut-out 180 encompassing the respective shank 144. In this position (see strap 168), longitudinal movement of each strap 168, 170 is substantially prevented and, because of the length of the tie strap extending inwardly beyond the cut-out and the lateral fit of the strap in the bar, lateral movement of the tie strap relative to the bar also is substantially prevented to assure lateral rigidity of the assembled parts. However, relative vertical movement is freely possible to permit vertical adjustments, as in leveling the assembly.

As shown in FIG. 7, when segments 154, 156 are moved into abutting relation with base plate 162, tie straps 168, 170 will overlap, and the openings 176 (FIG. 5) in respective straps will be in substantial alignment. A bolt 196, passed through the aligned openings and secured in position with nut 198, will, with the base plate unit 162, securely join the sub-assembly segments 154, 156, at a right angle.

Figure 9:
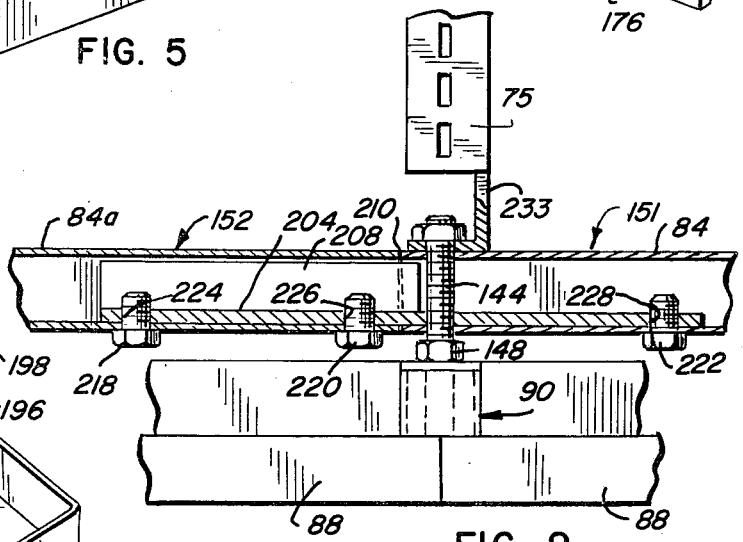
FIG. 9 is a vertical sectional view of a junction between adjacent longitudinally-extending support tubes.

When two adjacent sub-assembly segments 151, 152 are to be joined in coplanar alignment with one another, i.e., without any angle change therebetween as in FIGS. 2 and 9, only a single support unit 90 is utilized at the joint. As further explained hereinafter, it is important that the support unit 90 be positioned directly under the slotted support post 75 thereover so as to transmit any support weight or the like directly to the floor over which the assembly 10 is mounted. Thus the unit 90 is maintained in centered alignment with the superjacent joint between panels. Also, because of the lateral wall panel dimensions to achieve the desired unit-post relationship unit 90 will be positioned between and engage both abutting bases 88. As can be noted from FIG. 7, this same unit position is also necessary to properly support the assembly at a corner or change of direction.

Figure 10:
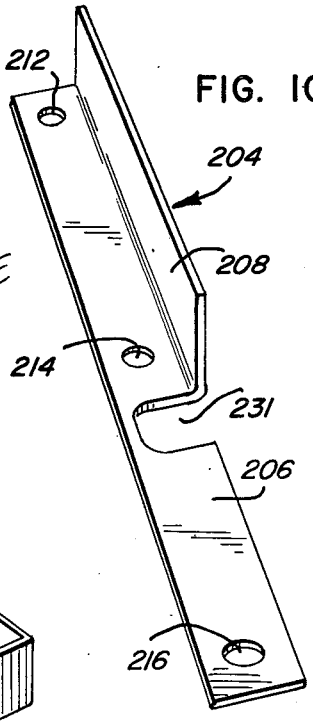
FIG. 10 is an enlarged perspective view of a connector splice strap of FIG. 9.

When a support bar 84 terminates at a linear joint, an extruder splice assembly is used as in FIG. 9. An extender support bar is used as at 84*a* in FIG. 9, which is slightly shorter than bar 84 and does not have the aligned openings 158, 160 at the respective abutting end. Structural rigidity is assured by a splice piece 204, whereby the necessity for an additional support unit is alleviated. The respective support bars 84, 84*a* and bases 88, thus are secured in an aligned abutting relation via the spanning or splicing piece 204 mounted in and extending between the respective support bars. The splice piece 204 (FIG. 10), includes a flat bar-securing portion 206 and an upstanding bracing flange 208 which extends along the flat portion 206 a predetermined distance and is adapted to span the junction 210 between abutting bars 84 when in place, as shown in FIG. 9. Three threaded openings 212, 214, 216 are provided along flat portion 206, which securely accommodate bolts 218, 220, 222 (FIG. 9) therein. Corresponding openings 224, 226, 228 are also provided along the bars 84, through which bolts 218, 220, 222 pass. With reference to FIG. 10, the splice piece 204 is also provided with a U-shaped cut-out 231, in which a shank 144 will be accommodated when the splice is in place. The splice 204 is inserted into the hollow inside of the adjacent bar 84 in a fashion similar to that described in conjunction with tie straps 168, 170, and shown in FIG. 5. Unlike the tie straps 168, 170, however, the U-shaped cut-out 231 of splice 204 is of a wider dimension, and is not intended to limit movement of the splice 204 longitudinally of leveling bars 84, 200. Relative longitudinal movement is prevented by the engagement of the bolts in the splice bar. The bar is of lateral dimensions to fit closely within the hollow bars **84, 84*a*** to ensure alignment of the bars and provide rigidity across the joint.

Figure 8:
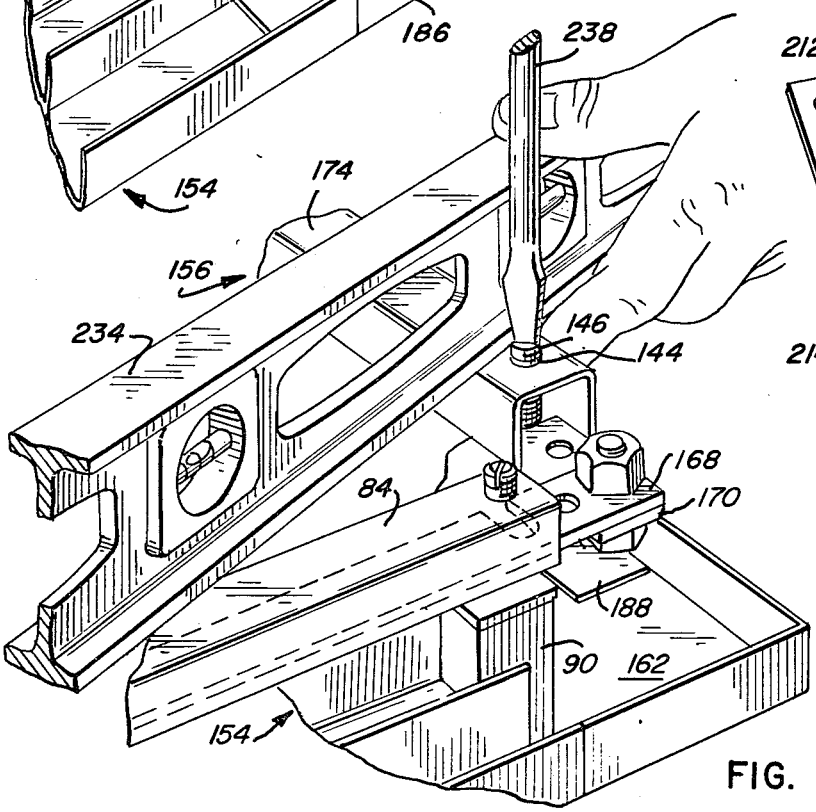
FIG. 8 is a perspective view as FIG. 7, illustrating a leveling technique employed according to the teachings of the invention.

To alleviate the need to level sub-assembly segments and/or wall panels separately, the entire assembly 32 is leveled from a leveling reference point—typically at one end of the sub-assembly 32 (FIG. 2). As an example, using the height of the support bar 84 over unit 86 as the leveling reference point, a carpenter's level 234 similar to that shown in FIG. 8 is laid along bar 84. Shanks of unit supports 86, 90 and of successive segments are then adjusted to level the bar(s) 84 according to the carpenter level's indications.

When the first sub-assembly segment 151 or joined segments 151, 152 have been leveled according to the above procedure, each following segment must be leveled relative thereto and, therefore, relative to the leveling reference point. As shown in FIG. 8, for example, to bring an adjacent bar 174 to the reference level height of bar 84, the carpenter's level 234 is placed across the adjacent support bars. The end of the second bar 174 is then brought to the level height by adjusting the respective shank 144 and its attached nut 148. This is accomplished by inserting a screwdriver 238 into slot 146 provided in the end of shank 144 and rotating it to adjust the shank relative to the respective unit housing (not shown). Once the level height has been achieved on that end of the bar 174 the carpenter's level 234 is placed along the bar 174, and the support unit on the opposite end is adjusted according to the carpenter level's indication. In this manner all sub-assembly segments may be leveled progressively relative to a single reference point.

After joining sub-assembly segments 151, 152, 154, 156 into a complete sub-assembly 32, deciding upon any final assembly layout changes, and subsequently leveling the support bars of the entire sub-assembly 32, the wall panels 12, 14, 16, 18 and associated component parts thereof will be mounted over the sub-assembly 32. One slotted post 74, 75 (FIGS. 12, 24) typically is attached to each wall panel 16 in a side groove 76 provided along the frame 72 prior to erection of the partition, for ease of assembly. For example, one post may be so attached to each panel in a factory preassembly. Each post functions not only to securely join the component parts of the wall assembly 10 together, as further explained below, but to support wall-mounted units selectively attached thereto.

Referring particularly to FIGS. 11–13 and 24, each post 74, 75 includes a hollow square tube 242 provided with a plurality of elongated, longitudinally-aligned slots 244 on opposite, outwardly facing, sides of the tube 242 (FIG. 13), and two L-shaped end brackets 247, 248 welded along one leg thereof to an inside surface of tube 242. The tubes 242 are of a size to fit snugly in the side grooves of the panel frames 72, with gap 48 defined between two adjacent wall panels permitting access to the slots 244 by hanging brackets 50, 52 (FIGS. 13, 24). The slotted post 74 is secured to frame 72 of wall panel 16 by wood screws 249, 251 which pass through openings 250, 252 in the brackets 247, 248. When so secured in place, respective laterally-extending flanges 262, 264 of the L-shaped brackets 247, 248, are flush with the bottom surface of upper and lower frame grooves 78, 82.

An opening 263, 265 is provided in each flange 262, 264. The opening 263 in upper flange 262 accommodates an upwardly extending threaded bolt shank 266 of a bolt which is securely welded to the undersurface of flange 262. As further described hereinafter, shank 266 cooperates with a panel tie piece 83 (FIG. 12) to secure adjacent panels and support posts 74, 75 together and align the panels. Opening 265 on the lower flange 264 is adapted to receive a shank 144 therethrough and thereby facilitate the securing of the slotted post 74 over a unit 86, 90 when a corresponding nut 150 is secured on shank 144.

When adjacent panels 16, 18, for example, have been positioned along bars 84 each slotted post 74 will be engaged in the opposed frame side grooves 76, (FIG. 13) with the slots 244 accessible through the openings 48 between the panels. Moreover, each post is hidden by the panels and the protruding compressible strips 54, 56, 58, 60 which close the slots 48. Because of the cross-sectional dimension of the slotted post 74 relative to the depth of grooves 76 on adjacent panels 16, 18, the space 48 between the panels is accurately determined.

To further secure the panels 16, 18 in their adjacent mutually supportive relation and to insure vertical and lateral alignment of the panels, a top tie piece 80 extends across the junction between the panels and is secured to each panel and to the intervening post. Tie piece 80 is substantially U-shaped in cross-section, and is adapted to fit snugly in the upper groove 78 of each panel. Downwardly extending nubs 272, 274 are adapted to be force-fitted into corresponding openings 276, 278 along frame 72. A centrally located opening 277 is provided, through which shank 266 of slotted post 75 extends. The tie piece 80 is secured in place by tightening a nut 279 over the shank 266 to maintain the positioning and supportive relation.

Figure 17:
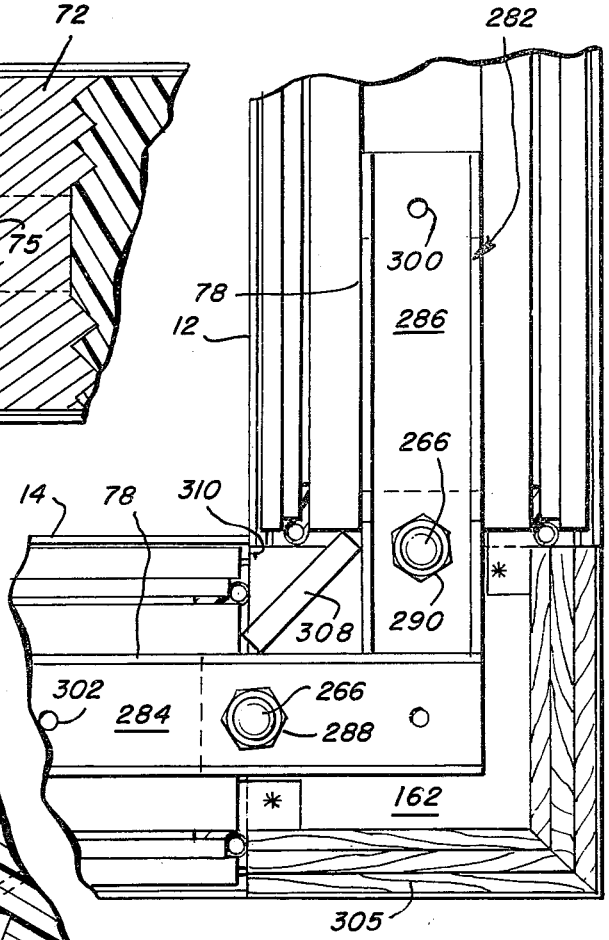
FIG. 17 is a top plan view of a right angle wall panel junction.
Figure 18:
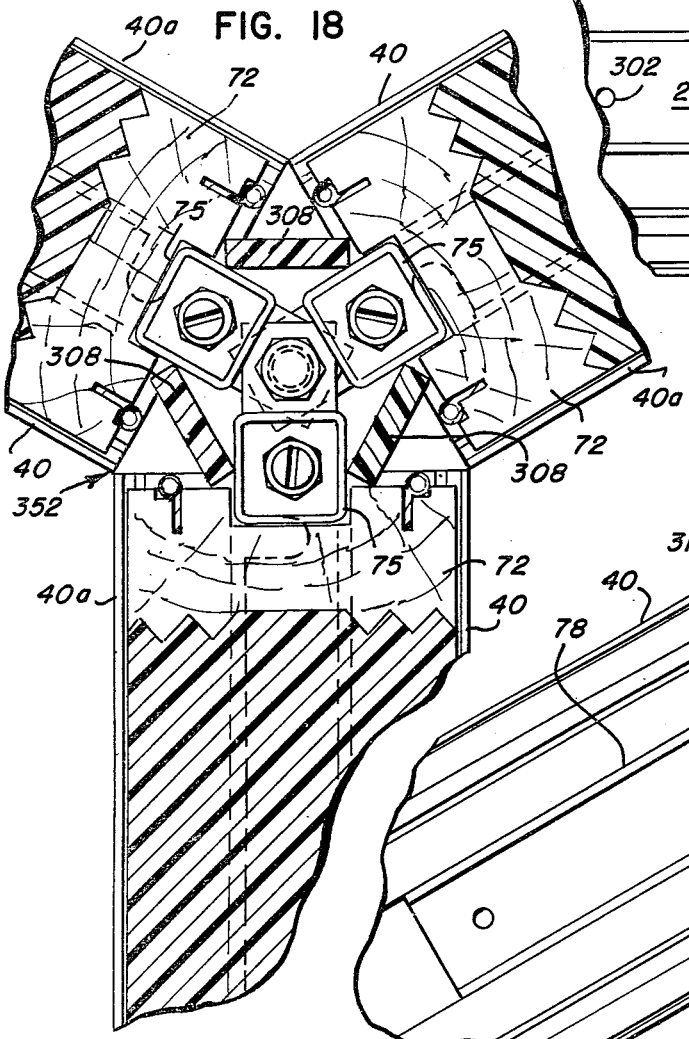
FIG. 18 is a sectional view, similar to FIG. 16, illustrating a three-way equi-angular wall panel junction.
Figure 19:
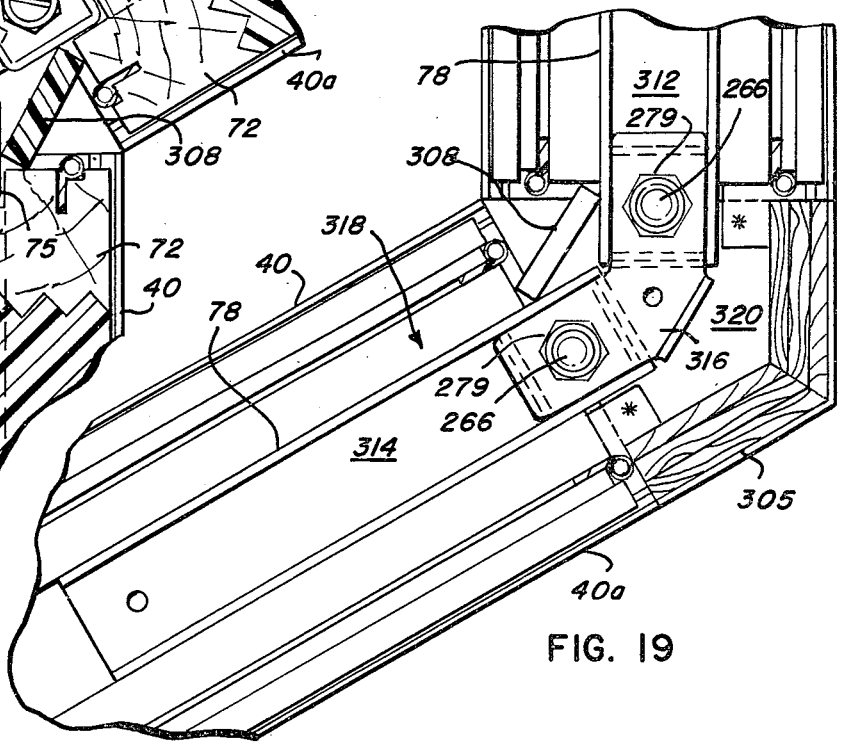
FIG. 19 is a top plan view, similar to FIG. 17, illustrating a 120° wall panel junction.
Figure 25:
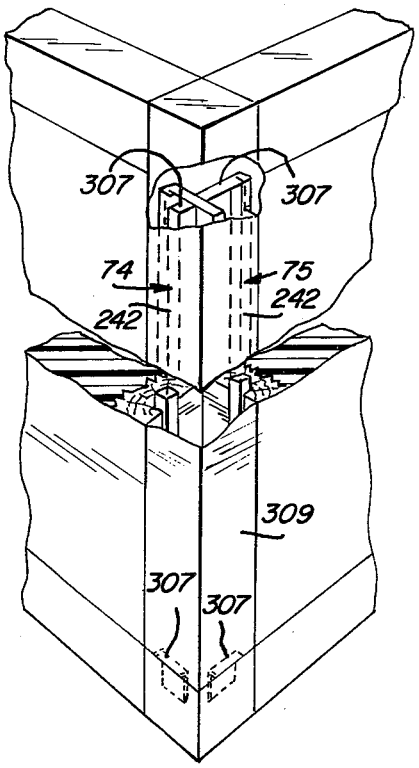
FIG. 25 is a fragmentary perspective view of a filler piece shown in place in a right angle connection.

As will be noted from FIG. 12, a modified tie piece 83 is utilized between adjacent panels which describe a predetermined angle. Another modified or partial tie piece 281 is used to join and align the top of an end panel with the end post **75*a*, see FIGS. 11, 12 and 15. FIGS. 17 and 19 illustrate other tie piece modifications that may be utilized, depending on the angular relationship to be achieved between the panels. FIG. 17, for example shows the top piece 282 used in conjunction with the right angle subassembly connection shown in FIG. 7 between panels 12, 14. The tie piece 282 is formed from two straight U-shaped portions 284, 286, welded together at a right angle. Because there is a slotted post associated with each support unit and the corresponding edges of each panel at the right angle corner, two openings 288, 290 are provided to accommodate respective upwardly extending shanks 266 of the respective vertical posts. The tie piece 282 is adapted to fit in top grooves 78 of the panels 12, 14 with downwardly-extending nubs 300, 302 being secured in the openings 276, 278 of the two frames. A flexible elongated block strip 308 extends the height of the panels, and is inserted into the corner connection to prevent any visible reflection through the inner corner opening 310 between adjacent panels 12, 14. To fill in the outer side of the corner, substantially rigid filler strip 305 extends the height of the panel assembly. This strip is hung over the end of hollow tubes 242 of posts 74, 75 at the top and bottom of the posts, via hanger pieces 307 (FIG. 25**).

In a similar fashion, in FIG. 19 two U-shaped straight pieces 312, 314 are welded to an angled piece 316 to form a top piece 318 for use with a 120° change of direction, see FIG. 19. It should be appreciated that a top piece can be formed to secure wall panels defining a variety of angles or junctions between themselves, according to the teachings set forth herein.

Figure 20:
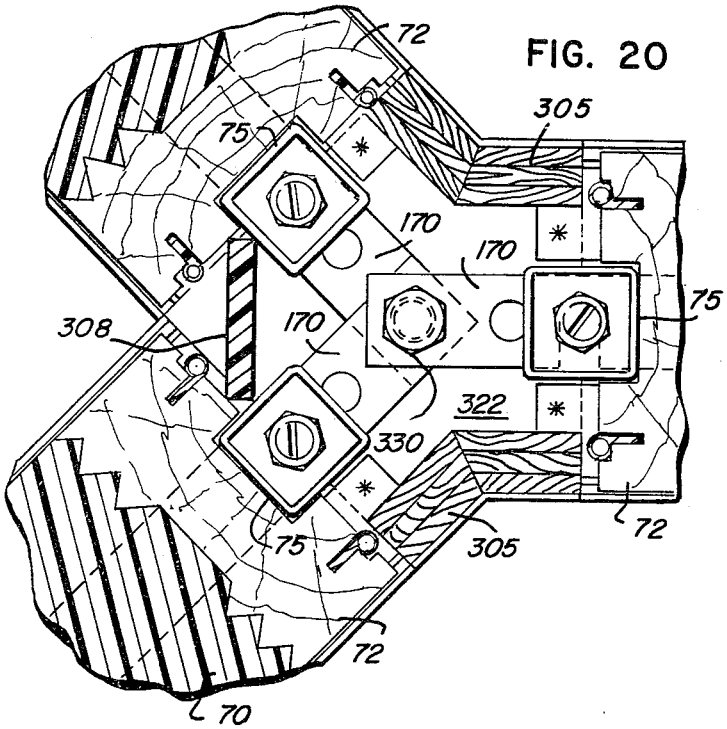
FIG. 20 is a sectional view, similar to FIG. 16, illustrating a three-way 135°-90°-135° wall panel junction.
Figure 21:
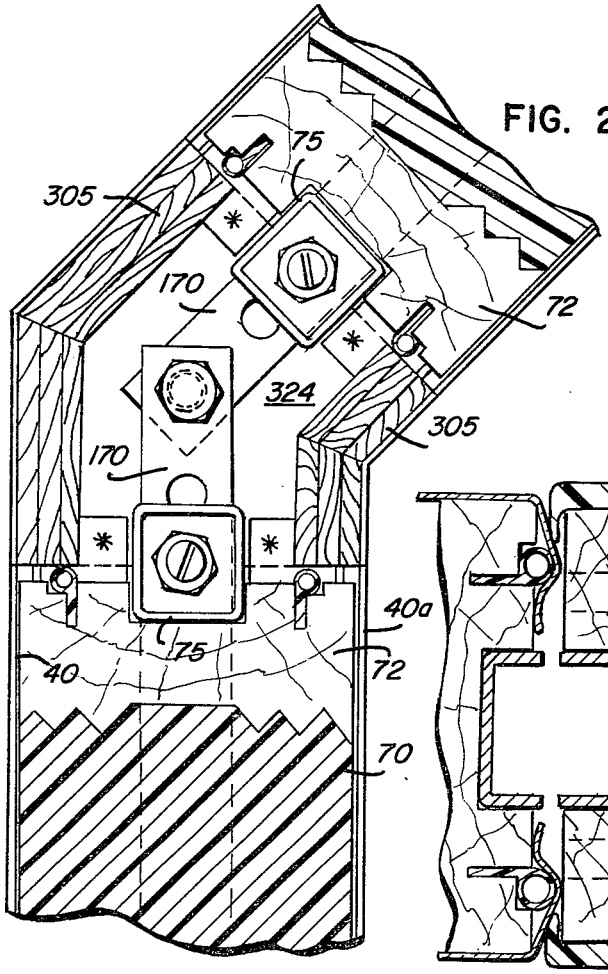
FIG. 21 is a sectional view, similar to FIG. 16, illustrating a 135° wall panel junction.
Figure 23:
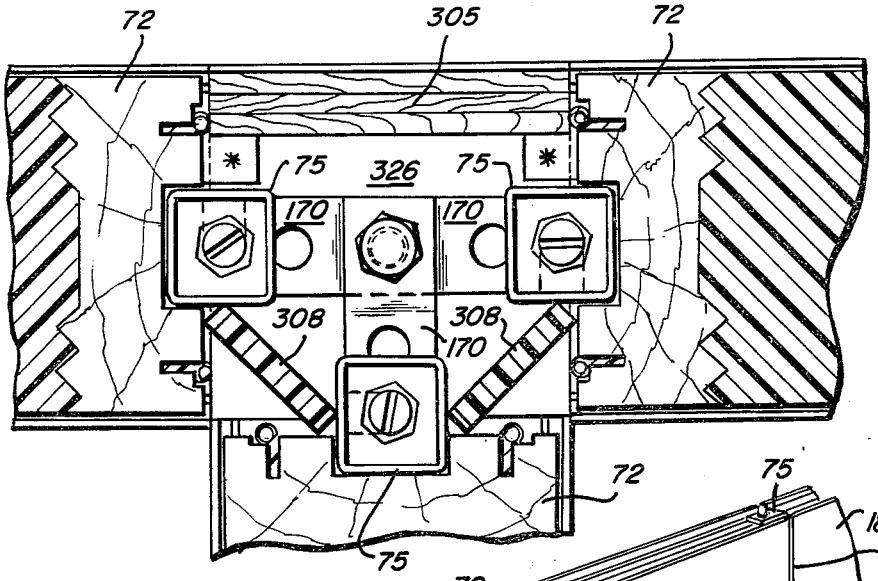
FIG. 23 is a sectional view, similar to FIG. 16, of a three-way T-connection between wall panels.

In conjunction with establishing predetermined angular wall panel junctions or changes in direction, a specialized base plate similar to the right angle plate 162 of FIG. 7 is used for certain angle changes. In FIGS. 19, 20, 21, 23, for example, respective base plates 320, 322, 324, 326 are positioned between adjacent wall panels and their sub-assemblies. With reference particularly to FIGS. 20, 21, 23, tie straps 170 extend from respective support bars (not shown) and, with end openings on each strap being in substantial overlapping alignment, are secured by passing a bolt 330 through the openings.

A base plate is utilized between panels when the angle or junction formed would prevent complete closure of the space between the panels while maintaining a uniform wall surface. As such, when a base plate is employed, filler pieces may be employed in conjunction therewith to properly fill the space between the panels in the same general manner as strips 309 in FIG. 25. However, when a four-way junction 350 (FIG. 16) or equi-angular three-way junction 352 (FIG. 18) is contemplated, neither a base plate nor filler pieces are necessary to finish the junction, as the edges of the wall panels will substantially define a corner at each edge with adjacent panels.

Exposed wall panel edges along the top and sides of the wall panel assembly are finished by top caps 24, 26, 28, 30 (FIGS. 1, 11, 12) and end caps 20, 22. The caps are elongated wooden covers having an aesthetic outward appearance, and are screwed in place over the tops and ends of the assembly by securing screws 381 through countersunk openings 380 in each cap and into the frame 72, see FIG. 11. As shown in FIG. 3, top cap 30, for example, is provided with elongated slots 382, 384 which are adapted to receive upstanding flanges 386, 388 of top piece 80. In this fashion the top pieces 80, 83, 281 etc., assure proper alignment of the top caps over the wall panel frames 72. Compressible filler strips 390, 392 are stapled into frame recesses 394, 396 and substantially close the space between the top cap 30 and wall panel 18. Securing the top caps over the noted flanges provides adjustment to insure uniform flat installation of the caps despite any tendency of the caps to warp. Also, the caps may be continuous across the linear joints to increase the rigidity of the system.

At the end 20 of the wall panel assembly, a slotted post **75*a* (FIG. 12) extends from the bar 84 to top piece 281, being secured in groove 76. However, because this post 75*a* is only partly retained in groove 76, the post 75*a* will extend beyond the panel side wall. A groove 404 (FIG. 22) is provided in the side or end cap 20 to accommodate and conceal the post 75*a* when the cap 20 is in place. As with the top cap 30, compressible strips 406, 408 accommodated in frame recesses 410, 412, will substantially close the space 414 between the cap 20 and wall panel 12 while allowing a mounting bracket similar to that shown in FIGS. 13 and 24 to pass through the opening and hook into slotted post 75*a***.

Figure 22:
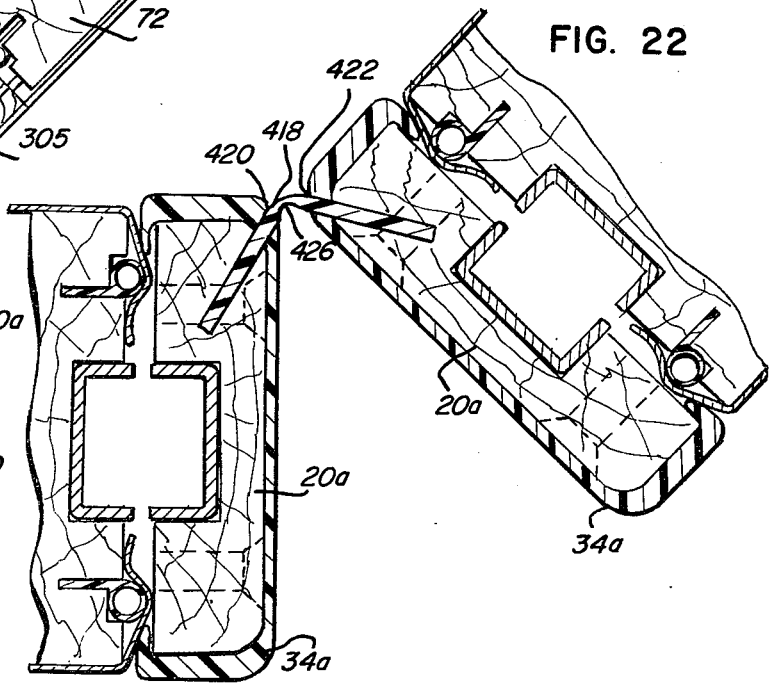
FIG. 22 is a sectional view, similar to FIG. 16, illustrating a hinged junction between wall panel ends.

As shown in FIG. 22, end caps **20*a* on adjacent wall panels can be modified to accept a substantially flexible sturdy, preferably black plastic hinge 418 extending the height of the wall panel assembly and capable of defining a variety of angles between adjacent wall panels. Slots 240, 422 are provided in each end cap 20*a* into which strip 418 is inserted and secured. Depending on the desired angle between the adjacent panels the hinge strip 418 will bend along its central crease 426 to thereby allow the adjacent panels to be disposed from one another at any desired angle or to be repeatedly adjusted in the manner of a hinged door. The strip 418** will also provide limited structural support between the panels.

Figure 14:
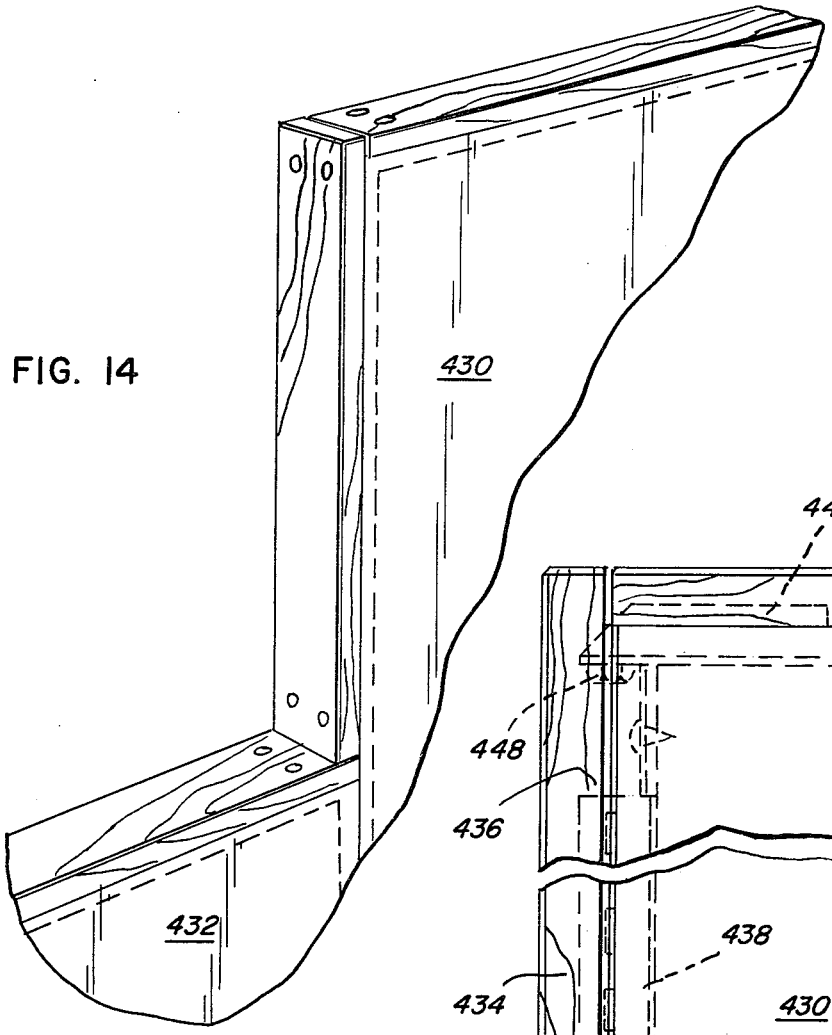
FIG. 14 is an enlarged perspective view of a junction between wall panels of different heights.
Figure 15:
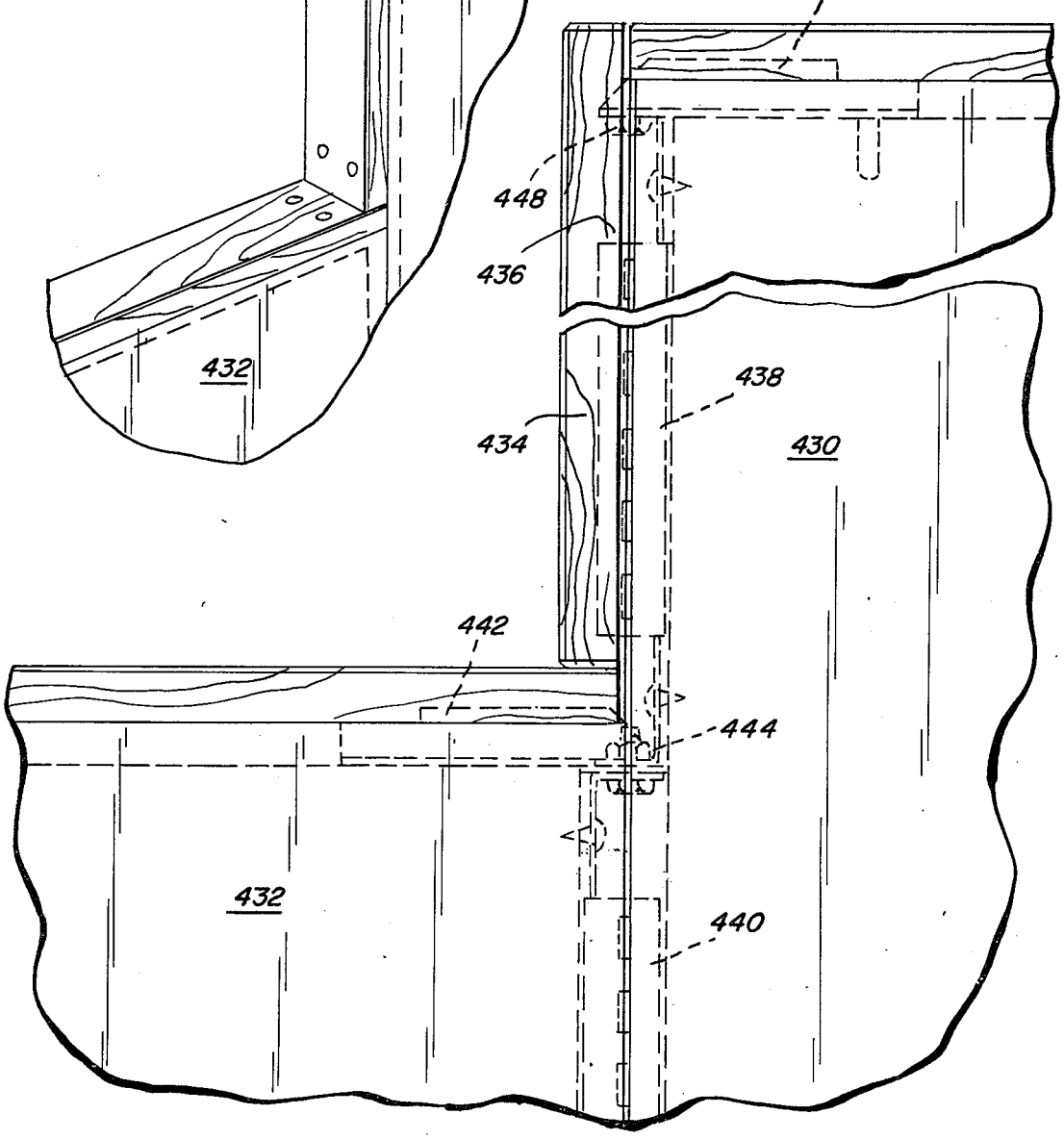
FIG. 15 is an enlarged front elevational view of the wall panels of FIG. 14, with structural support parts shown in phantom.
Figure 16:
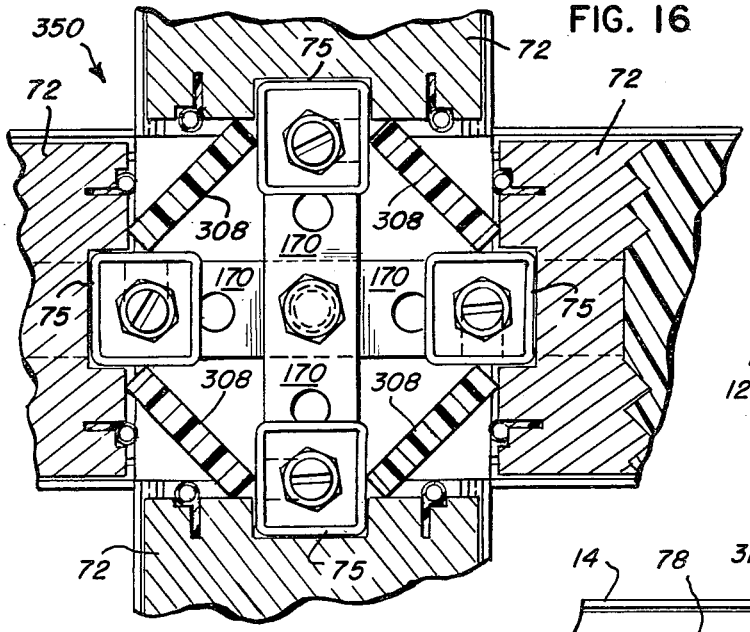
FIG. 16 is a sectional view of a four-way wall panel junction taken through the mid-section of the panels and looking downwardly.

In addition to the variety of angles and/or junctions at which adjacent wall panels of the movable wall assembly 10 can be disposed, it is also envisioned that wall panels of different heights can be joined together, as shown by panels 430, 432 in FIGS. 14 and 15. An abbreviated end cap 434 is adapted to finish the exposed portion of wall panel 430 extending above the shorter panel 432 and accommodate, in a concealed back groove 436 (FIG. 15), an abbreviated slotted support post 438. The abbreviated slotted post 438 is secured to the top of the underlying slotted post 440 and top end piece 442 via a nut and bolt connection 444. At the top end of the abbreviated post 438, it is secured to another top end piece 446 via the nut and bolt connection 448. In this configuration, a wall mounted unit (not shown) can be hung on the extended panel 430 above its junction with lower panel 432.

Each wall hanging bracket 52 is L-shaped, and includes a hooked flange 50 adapted to engage the slotted support post 74, 75 through openings 244 thereof. Back flange 51 extends at a right angle from hooked flange 50, and includes an upper mounting tongue 453 which is adapted to engage with an elongated mounted strip 455 carried on wall unit 46. Mounting strip 455 is substantially U-shaped, and is adapted to hook over tongues 453 to secure the hanging unit 46 on the wall 16. The strip 455 is provided with end stops **455*a* at each end of the strip which prevent the strip 455 from sliding off of tongues 453, while permitting limited lateral positioning of the wall unit 46 over the wall 16**.

A lower tongue **453*a* is adapted to be engaged by an L-shaped angle piece 457 which is secured over the lower inner corner of unit 46, with upwardly extending flange 457*a* being spaced from the unit's back and accommodating tongue 453*a* therebetween. This arrangement will thus prevent inadvertent dislodging of the wall unit 46 from mounting brackets 52**.

The wall brackets 52 are inserted into the slotted posts prior to mounting the wall unit 46 thereon, by inserting hook fingers 459 into slotted openings 244. A lock piece 461 on the lower end of each bracket 52 will also be accommodated in a slotted opening after the hooked fingers 459 are inserted into the slotted post and the bracket is moved downward. The lock piece is dimensioned to completely fill the longitudinal extent of a slotted post opening when the hooks 459 are in place within openings 244 and thereby prevent the brackets 52 from becoming dislodged from the slotted post if an upward force is transmitted to the brackets, as by bumping the hanging unit 46.

The unit 46 is then hung by engaging the strip 455 over tongues 453 of a pair of brackets. The safety piece 457 is then positioned over lower tongues 453*a* and secured to the unit 46 to prevent inadvertent detachment of the unit from the tongues 453.

Thus, a movable wall assembly is provided which meets the aforestated objects. The assembly is quickly and easily assembled and/or moved and reassembled, presents a pleasing appearance, is of simple and uncomplicated construction, and yet is easily and quickly leveled, being sturdy and able to support a plurality of wall-mounted units. The partition elements are assembled entirely atop the leveling support tube, which conveniently may be preleveled as described. The slotted posts and cooperating elements secure the panels and related components in consistently aligned positions. Moreover, the posts are supported by the panels against bending when heavy wall hanging units are applied, and the positioning of the posts on the support elements insures direct linear transfer of the vertical load to the support floor, substantially avoiding beam loading of the leveling support bar.

While a particular embodiment of the invention has been shown, it will be understood, of course, that the invention is not limited thereto since modifications may be made and other embodiments of the principles of this invention will occur to those skilled in the art to which this invention pertains upon considering the foregoing teachings. It is, therefore, contemplated by the appended claims to cover any such modification and other embodiments as incorporated in those features which constitute the essential features of this invention within the true spirit and scope of the following claims.

What is claimed is:

1. A movable wall assembly for selectively partitioning an interior space comprising, in combination, an elongated base; adjustable support elements spaced along said base; elongated leveling support means mounted on said support elements and adjustable therewith to effectuate leveling of said support means; wall panels supportably mounted on said leveling support means; a vertical post member at each vertical edge of said panels, each of said posts being supported on said support means and engaging the adjacent vertical edge of the respective panel; and tie means engaging upper portions of adjacent panels for mutual support thereof, whereby said levelling support means is adapted to be leveled prior to assembling said panels and post members thereon.

2. A wall assembly as in claim 1 wherein each of said posts is secured on one of said support elements.

3. A wall assembly as in claim 2 wherein each of said posts extends substantially the full height of the respective panel.

4. A wall assembly as in claim 3 wherein said tie means includes a tie piece secured to the upper end of each of said posts and attached to each of said panels adjacent the respective post.

5. The assembly of claim 1 wherein each wall panel is a structually integral unit.

6. The assembly of claim 1 wherein said vertical post members and said wall panels cooperate along side edges of said wall panels for mutual support.

7. The assembly of claim 6 wherein each of said post members extends between and is anchored between said tie means and said support means.

8. The assembly of claim 6 wherein said post members include vertically-spaced openings which are adapted to accommodate a wall unit bracket engaged thereon, adjacent panels being spaced to provide access to said openings.

9. The assembly of claim 8 wherein compressible means carried in adjacent wall panel edges normally close the space between said adjacent panels.

10. The assembly of claim 9 wherein said wall unit brackets extend between and compress said compressible means.

11. The assembly of claim 1 wherein each of said vertical post members is in substantially vertical alignment with one of said support elements.

12. The assembly of claim 11 wherein said vertical post members are attached to said corresponding support elements.

13. The assembly of claim 11 wherein each of said support elements includes a shank portion, said shank portion extending through said elongated support means and adapted to facilitate attachment of said respective vertical posts over said support means.

14. The movable wall assembly of claim 1 wherein said base is substantially U-shaped in cross-section, and is partitioned into two cable-accommodating troughs.

15. The assembly of claim 14 wherein said base includes a support element trough along which said support elements are spaced, said support element trough effectively separating said cable-accommodating troughs.

16. The assembly of claim 14 including upstanding cover plates adapted for removable hooking engagement on portions of said base and extending between said wall panel members and the surface on which said base is supported to effectively cover said base.

17. The assembly of claim 1 wherein each of said adjustable support elements includes a support housing and a shank adjustably accommodated in and extending from said housing, said shank having an adjusting element secured thereto to carry the support means mounted thereon and being adjustable with said shank to effect leveling of said support means.

18. The assembly of claim 17 wherein said elongated support means is a hollow tube having aligned top and bottom openings adjacent the ends thereof, said hollow tube being mounted on said support elements and abutting said adjusting element on each support element shank, and said shanks extending through the aligned openings in each end of said support means.

19. The assembly of claim 18 wherein adjacent support means are secured in a predetermined angular relation by connector pieces mounted in and extending from respective ends of said hollow tube means.

20. The assembly of claim 19 wherein each connector piece includes a planar strap provided with a cut-out portion adapted to encompass a respective shank extending through said support means at one end thereof when said connector piece is mounted in said support means.

21. The assembly of claim 20 wherein a portion of each of said connector pieces extends from adjacent support means being secured together to thereby secure said support means in a predetermined angular relation.

22. The assembly of claim 20 including a single connector piece extending between abutting longitudinally aligned support means, said connector piece including an upstanding bracing flange and being secured to each of said abutting support means.

23. The assembly of claim 1 wherein each of said wall panels includes an integral frame.

24. The assembly of claim 23 wherein said frame includes a grooved outer surface along each edge thereof and is adapted to accommodate therein a portion of said vertical post member, said tie means, and said elongated support means.

25. The assembly of claim 24 wherein vertical edges of adjacent wall panels are spaced apart to provide a gap therebetween, said vertical post members extending substantially the full height of said panels and being provided with vertically spaced openings accessible through said gaps.

26. The assembly of claim 25 including wall hanging brackets adapted to extend through said gap and into certain of said vertically spaced openings.

27. The assembly of claim 25 wherein said gap between adjacent wall panels is closed by abutting compressible elongated strips extending from side wall panel frames of adjacent wall panels.

28. A wall assembly as in claim 2 including a post segment adjacent the upper portion of each such vertical edge of said panels and secured to one of said panels, and wherein said tie means includes a tie piece secured to the upper end of each such upper post segment and attached to each of said panels adjacent the respective post segment.

29. The assembly of claim 7 wherein each of said post members includes vertically-spaced openings which are adapted to accommodate a wall unit bracket engaged thereon.

* * * * *